US005292368A

United States Patent [19]

Komine et al.

[11] Patent Number: 5,292,368

[45] Date of Patent: Mar. 8, 1994

[54] DEVICE FOR APPLYING FLUID USING ROBOT CONTROLLED NOZZLES

[75] Inventors: Tetsuya Komine, Shinagawa; Katsutoshi Hosoi, Inazawa, both of Japan

[73] Assignee: Sony Corporation, Tokyo, Japan

[21] Appl. No.: 855,007

[22] PCT Filed: Aug. 28, 1991

[86] PCT No.: PCT/JP91/01139

§ 371 Date: May 4, 1992

§ 102(e) Date: May 4, 1992

[87] PCT Pub. No.: WO92/04725

PCT Pub. Date: Mar. 19, 1992

[30] Foreign Application Priority Data

Sep. 7, 1990 [JP] Japan ..... 2-38098

[51] Int. Cl.[5] ..... B05B 15/06; B05B 15/08

[52] U.S. Cl. ..... 118/315; 118/323; 427/64; 901/43

[58] Field of Search ..... 118/313, 315, 316, 323, 118/663, 696, 695; 427/64; 901/43; 414/909

[56] References Cited

U.S. PATENT DOCUMENTS

| | | | |
|---|---|---|---|
| 4,137,341 | 1/1979 | Adachi | 427/64 |
| 4,262,036 | 4/1981 | Mineyama et al. | 427/64 |
| 4,714,044 | 12/1987 | Kikuchi et al. | 901/43 |

FOREIGN PATENT DOCUMENTS

| | | | |
|---|---|---|---|
| 259739 | 9/1988 | Fed. Rep. of Germany | 118/315 |
| 63-32827 | 12/1988 | Japan . | |
| 1086532 | 7/1989 | Japan | 427/64 |
| 1289046 | 11/1989 | Japan | 427/64 |
| 3133025 | 6/1991 | Japan . | |
| 2190312 | 11/1987 | United Kingdom | 118/316 |

*Primary Examiner*—Joseph W. Drodge

*Attorney, Agent, or Firm*—Hill, Steadman, & Simpson

[57] ABSTRACT

First and second robots function to hold first and second nozzles, respectively, which are supplied with respective fluid coating materials. The robots move the nozzles along respective different paths over a surface to which the fluid coating materials are to be applied. The fluid coating materials are uniformly and efficiently applied over the surface, without any irregularities, using the combination of nozzles and robots. In addition, the first robot has a nozzle transfer function to hold the second nozzle as well. As a result, the first robot may hold both nozzles for application of the coating materials.

3 Claims, 9 Drawing Sheets

DEVICE FOR APPLYING FLUID USING ROBOT CONTROLLED NOZZLES

TECHNICAL FIELD

The present invention relates to a device for applying a fluid coating material, such as a glass frit, for example, as a sealing material.

BACKGROUND ART

FIG. 8 of the accompanying drawings shows, in side elevation, a color cathode-ray tube partly in cross section. As shown in FIG. 8, the color cathode-ray tube has a tube body 101 including a funnel 101*f* and a panel 101*p* which has a fluorescent inner surface coated with color fluorescent materials. The panel 101*p* has an open end hermetically sealed against the open end of the funnel 101*f* by a glass frit 102.

The glass frit 102 is in the form of a liquid, i.e., a fluid when it is applied. FIG. 9 of the accompanying drawings shows the open end of the funnel 101*f*. As shown in FIG. 9, the glass frit is applied to the open end of the funnel 101*f* by moving a nozzle for ejecting the glass frit, from a position P, as a starting point, in the direction indicated by the arrow a, e.g., clockwise in FIG. 9. When the nozzle reaches the position P as an ending point again, the nozzle is stopped, thus coating the glass frit to the entire open end of the funnel 101*f*. If the starting and ending points of the nozzle overlap each other in the position P, then the coated layer of the glass frit is thicker in the position P than the coated layer in the other positions on the open end. If an effort is made to prevent the glass frit from being coated in overlapping layers at the starting and ending points, then the starting and ending points tend to be spaced from each other with no sufficient coating layer of glass frit therebetween.

In the event that the panel 101*p* is joined to the funnel 101*f*, as shown in FIG. 8, with the glass frit being thus applied, the hermetic seal may be impaired in the region where the glass frit is not sufficiently coated, and tend to develop a crack after the tube body is evacuated to a high degree of vacuum. When the tube body cracks, its reliability is reduced, e.g., it may explode or the degree of vacuum therein may be lowered.

In the event that the glass frit is excessively applied in overlapping layers, the glass frit is apt to squeeze out of joint between the funnel 101*f* and the panel 101*p*. Since the squeezed glass frit is responsible for the generation of dust in the tube after it is dried, it is necessary to remove the squeezed glass frit.

If the length of the open end of the funnel 101*f*, i.e., the length of a distance to be coated with a frit seal, is large as with a cathode-ray tube of a 45-inch size, it is highly inefficient for the nozzle to move all the way in a loop along the open end of the funnel 101*f*. One solution is to move two nozzles from a starting point $P_1$ (see FIG. 10 of the accompanying drawings) along different paths, clockwise and counterclockwise as indicated by the arrows a, b, while applying a glass frit, and to stop applying the glass frit material from the nozzles at an ending point $P_2$ that is positioned in symmetric relationship to the starting point $P_1$. However, this coating process also suffers the above coating irregularities at the starting and ending points $P_1$, $P_2$.

It has been proposed to eliminate the above drawback with first and second nozzles 103, 104 as shown in FIG. 11A of the accompanying drawings, the first and second nozzles 103, 104 being closed with their open ends mating with each other. As shown in FIG. 11B of the accompanying drawings, when the nozzles 103, 104 are spaced from each other, they are opened to allow a supplied glass frit to flow or drop downwardly therefrom. The first and second nozzles 103, 104 are moved from the starting point P; (FIG. 10) clockwise and counterclockwise as indicated by the arrows a, b, while applying the glass frit. At the ending point $P_2$, the open ends of the nozzles 103, 104 are closed, bringing the application of the frit to an end, as shown in FIG. 11A. In reality, the first and second nozzles 103, 104 are individually moved by independent robots, respectively. Because of limited mechanical accuracy or the like, it is highly difficult to hold the nozzles in accurate alignment with each other and close them at a desired position without a positional error, as shown in FIG. 11A. Even if this process is employed, the glass frit cannot actually be coated without irregular coating layers.

According to the present invention, there is provided a device for applying a fluid coating material, such as any of various adhesives, paints, or a glass frit material, uniformly and efficiently without coating irregularities, as when the funnel and panel of a cathode-ray tube body are joined to each other through such a fluid coating material.

DETAILED DESCRIPTION OF THE PRESENTLY PREFERRED EMBODIMENTS

Figure 1:
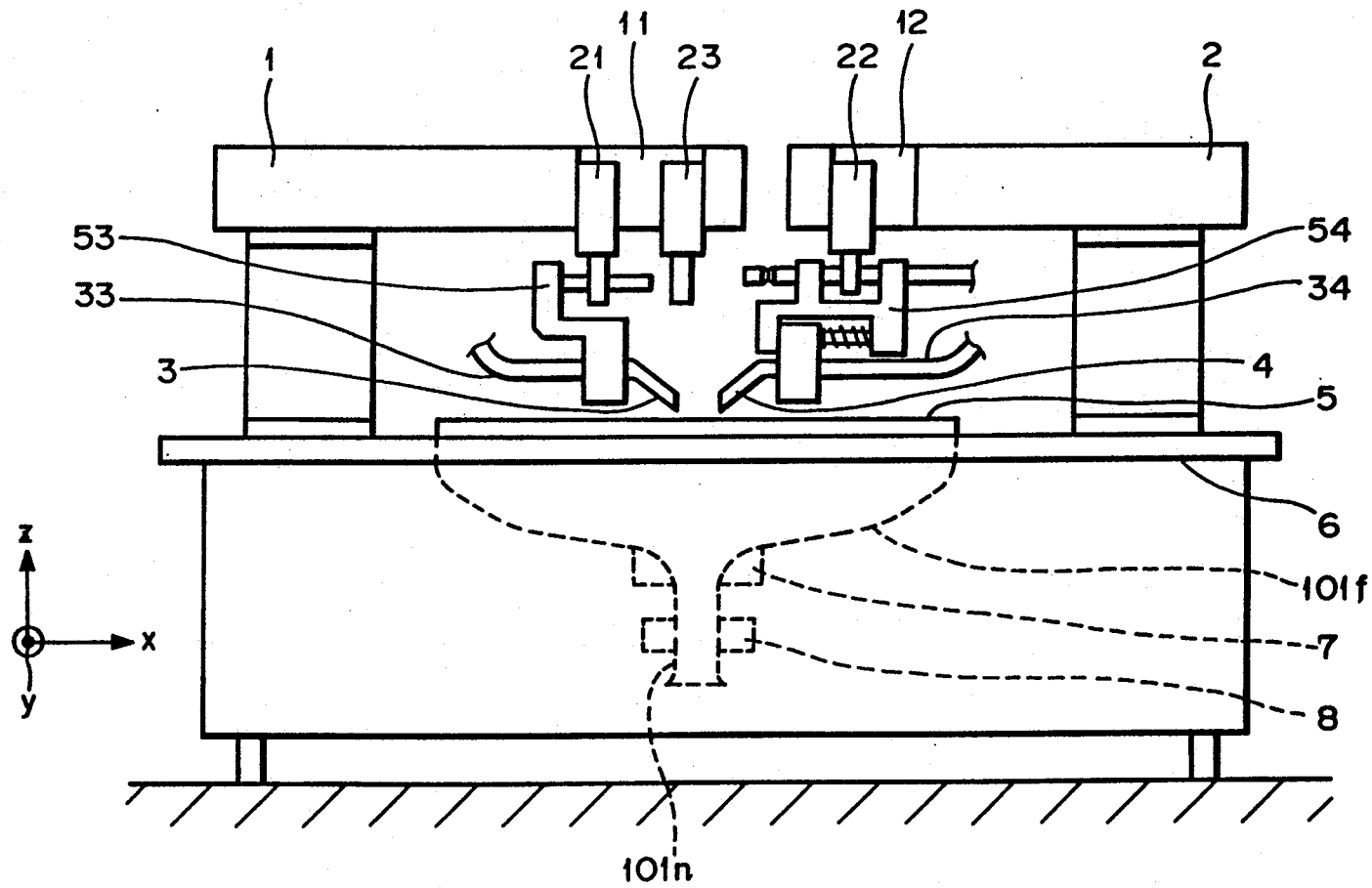
FIG. 1 is a schematic front elevational view of a device according to the present invention.
Figure 2:
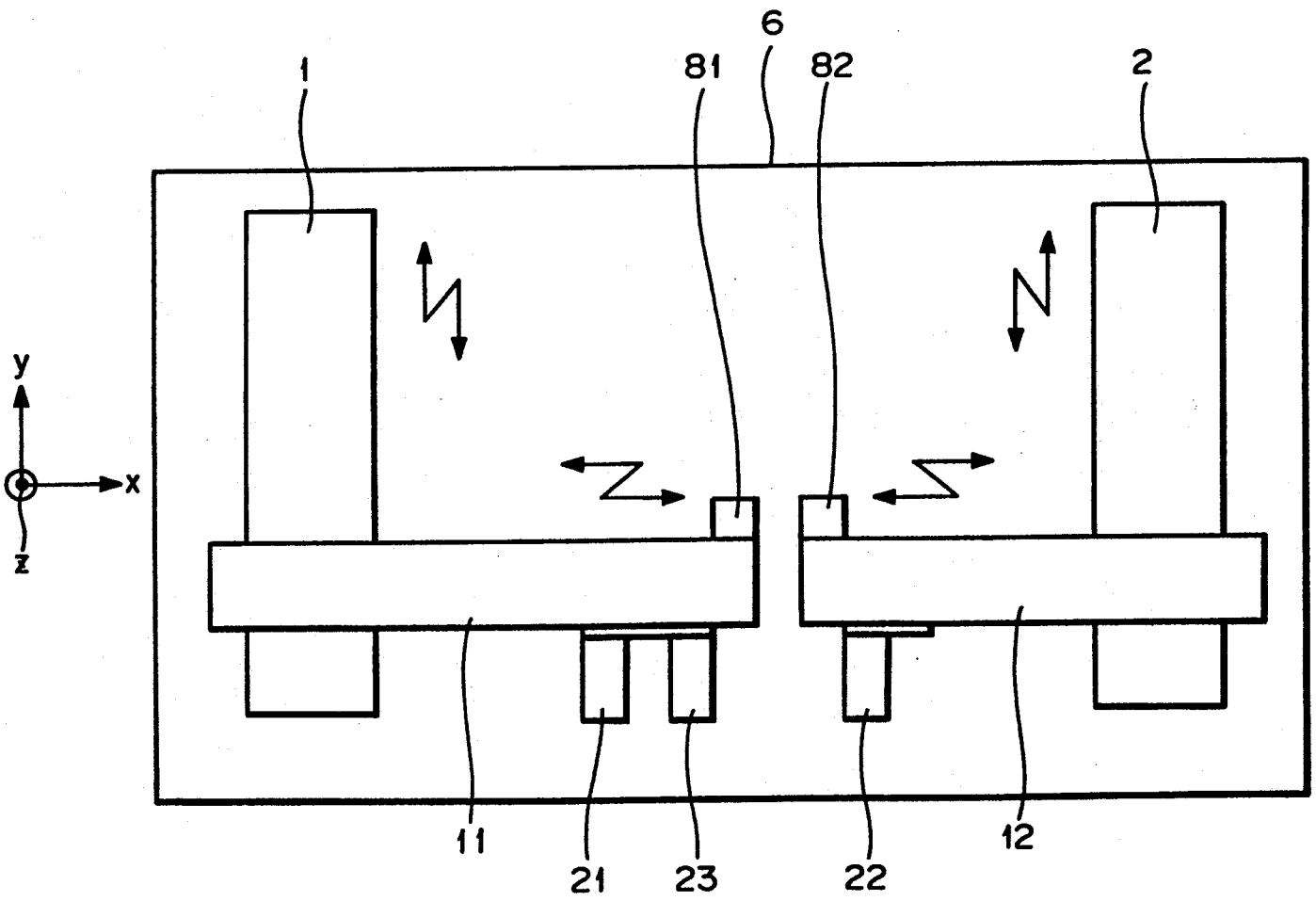
FIG. 2 is a plan view of the device according to the present invention.

As shown in FIG. 1, which is a front elevational view of a device for applying a fluid according to the present invention, and also in FIG. 2, which is a plan view of the device, the device has at least first and second robots 1, 2, and at least first and second nozzles 3, 4 supplied with respective fluid coating materials.

The first and second robots 1, 2 have a function to hold the respective first and second nozzles 3, 4 and move the nozzles 3, 4 along different paths over a surface 5 to be coated with the fluid coating materials, and also have a nozzle transfer function to transfer the nozzle 4, which has been held by the second robot 2, to the first robot 1 and enable the first robot 1 to hold both the first and second nozzles 3, 4.

According to the present invention, furthermore, the first and second nozzles 3, 4 are closed when they are held against each other, and opened when they are separated from each other.

The first and second nozzles 3, 4 move from a first position over the surface 5 along different paths, respectively, and meet each other at a second position, so that the first and second nozzles 3, 4 follow a closed or loop-like path as a whole.

With the above arrangement, the first and second nozzles 3, 4 are caused to follow respective different paths over the surface 5 by the respective first and second robots 1, 2. The nozzles 3, 4 coact with each other to apply the fluid coating material efficiently. Particularly, since one of the robots, e.g., the first robot 1 is capable of holding both nozzles simultaneously, the fluid can be applied by the common robot 1 at starting and ending points of the fluid applying process. Therefore, the starting and ending points of the fluid applying process can reliably be established in position. The nozzles 3, 4 can be aligned and opened at the starting and ending points of the fluid applying process, with the result that the fluid coating materials can reliably be applied to the surface 5 uniformly and efficiently without coating irregularities.

A device for applying a fluid according to an embodiment of the present invention will be described in detail below with reference to FIGS. 1 through 7. FIG. 1 is a frontal elevational view showing mainly robots of the device according to the invention, and FIG. 2 is a plan view showing mainly the robots of the device.

In the illustrated embodiment, a fluid coating material in the form of a glass frit is applied to a surface 5 of an open end of a funnel 101*f* of a cathode-ray tube body. First and second robots 1, 2 are supported on a base 6, which holds the funnel 101*f* in position to set the surface 5 to a predetermined position. The funnel 101*f* which has the surface 5 is positioned by a circumferential edge around the open end thereof which is held against a funnel rest 7 in the base 6. The cathode-ray tube body includes a neck 101*n* extending rearwardly from the funnel 101*f*, the neck 101*n* being gripped by a gripper 8.

The first and second robots 1, 2 have respective arms 11, 12. First and third nozzle chucks 21, 23 are mounted on a distal end portion of the arm 11 of the first robot 1, and a second nozzle chuck 22 is mounted on a distal end portion of the arm 12 of the second robot 2. The first and second robots 1, 2 are arranged such that the arms 11, 12, i.e., attached portions of the first, third, and second nozzle chucks 21, 23, 22 mounted on the arms 11, 12 are movable in at least one horizontal plane, e.g., an x-y plane.

Figure 3:
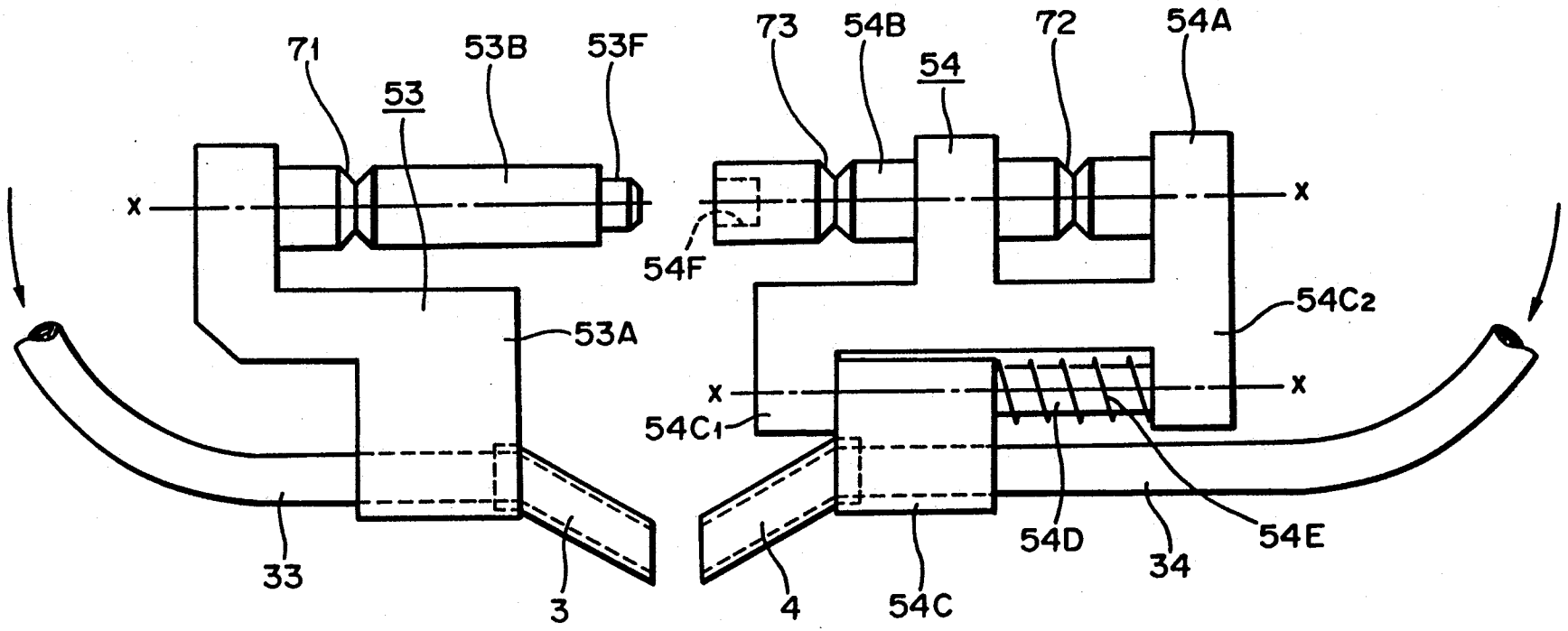
FIG. 3 is a side elevational view of a nozzle holding means for the device of the present invention.

As shown in FIG. 3, which is a side elevational view of nozzles and nozzle holding means, a fluid coating material, i.e., a glass frit, to be applied to the surface 5 is supplied to first and second nozzles 3, 4, and flows out of the first and second nozzles 3, 4. The first and second nozzles 3, 4 comprise open end members mounted on respective distal ends of flexible supply pipes 33, 34, the open end members being rigid to some extent and preferably somewhat soft. The nozzles 3, 4 are positioned such that their distal end surfaces can mate with each other, and are closed in a fluid-tight fashion when they mate with each other.

The nozzles 3, 4 are held by respective nozzle holding means 53, 54.

The nozzle holding means 53 has a holder 53A which holds the nozzle 3 and the supply pipe 33, and a rod 53B mounted on an upper end of the holder 53A and having an axis extending in a horizontal direction indicated by the arrow x.

Likewise, the nozzle holding means 54 has a holder 54A with a rod 54B mounted on an upper end thereof and having an axis extending in the direction x. The nozzle holding means 54 also has a movable holder 54C which holds the nozzle 4 and the supply pipe 34, and which is resiliently movable over a small distance in the direction x. The movable holder 54C is supported on a guide rod 54D extending between a pair of arms $54C_1$, $54C_2$ on the lower end of the holder 54A, the guide rod 54D having an axis extending in the direction x. The movable holder 54C is resiliently urged by a spring 54E interposed between the movable holder 54C and one of the arms, e.g., the arm $54C_2$, and is movable by an air cylinder.

The rod 53B, for example, has a projection 53F on its distal end, and the rod 54B has a recess 54F in its distal end for receiving the projection 53F. The rods 53B, 54B can be aligned and joined with each other along the same axis x with the projection 53F fitted in the recess 54F when the arms 11, 12 of the first and second robots 1, 2 are moved.

The nozzle holding means 53, 54 are gripped and held by first, second, and third nozzle chucks 21, 22, 23 mounted on the arms 11, 12 of the first and second robots 1, 2.

Figure 4:
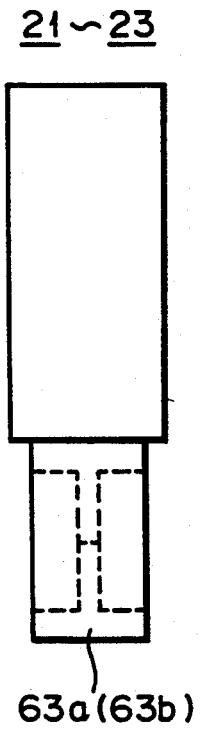
FIGS. 4 and 5 are front and side elevational views, respectively, of each nozzle chuck for the nozzle holding means of the device of the present invention.
Figure 5:
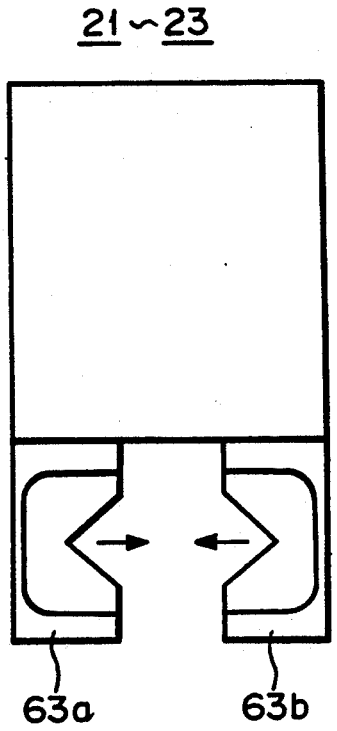

The nozzle chucks 21, 22, 23 are shown in the front elevational view of FIG. 4, and the side elevational view of FIG. 5. As shown in FIGS. 4 and 5, each of the nozzle chucks 21, 22, 23 has a pair of gripping fingers 63*a*, 63*b* resiliently movable toward and away from each other for gripping one of the rods 53B, 54B at either one of grooves 71, 72, 73 defined therein.

As shown in FIG. 2, the robots 1, 2 have respective cameras 81, 82.

With the nozzle holding means 53, 54 being gripped and held by the first and second nozzle chucks 21, 22, the robots 1, 2 have a function to move the nozzles 3, 4 respectively clockwise and counterclockwise in the directions indicated by the arrows a, b (see FIG. 10) from the position $P_1$ over the surface 5*a* of the open end of the funnel 101*f*, for example, supported on the base 6, to the other position $P_2$, i.e., along different paths.

The robots 1, 2 also have a nozzle transfer function to transfer the nozzles 3, 4 between a mode in which the nozzles 3, 4 mate with each other and are closed, with the first and third nozzle chucks 21, 23 of the first robot 1 gripping and holding the rods 53B, 54B of the nozzle holding means 53, 54 at the respective grooves 71, 73, and a mode in which the third nozzle chuck 23 is released and the second nozzle chuck 22 of the second robot 2 grips and holds the rod 54B at the groove 72, so that the nozzles 3, 4 can be moved independently of each other when the first and second robots 1, 2 move.

A process of applying a frit as a fluid coating material to the open end of the funnel 101*f* with the fluid applying device will be described below. The funnel 101*f* is set to a predetermined position in the base 6. At this time, the nozzles 3, 4 are held in the other position $P_2$ by the nozzle holding means 53, 54. The distal ends of the nozzles 3, 4 mate with each other and are closed to prevent the fluid coating material from leaking out. The funnel 101*f* is held in position in the base 6 by an abutting portion (not shown) of the base 6 which abuts against an outer circumferential surface of the funnel 101*f*, the funnel rest 7, and the griper 8 which grips the neck 101*n*.

The position, shape, etc., of the funnel surface 5 are measured by the cameras 81, 82 of the robots 1, 2, and the measured data are stored in a computer, for example.

Figure 6:
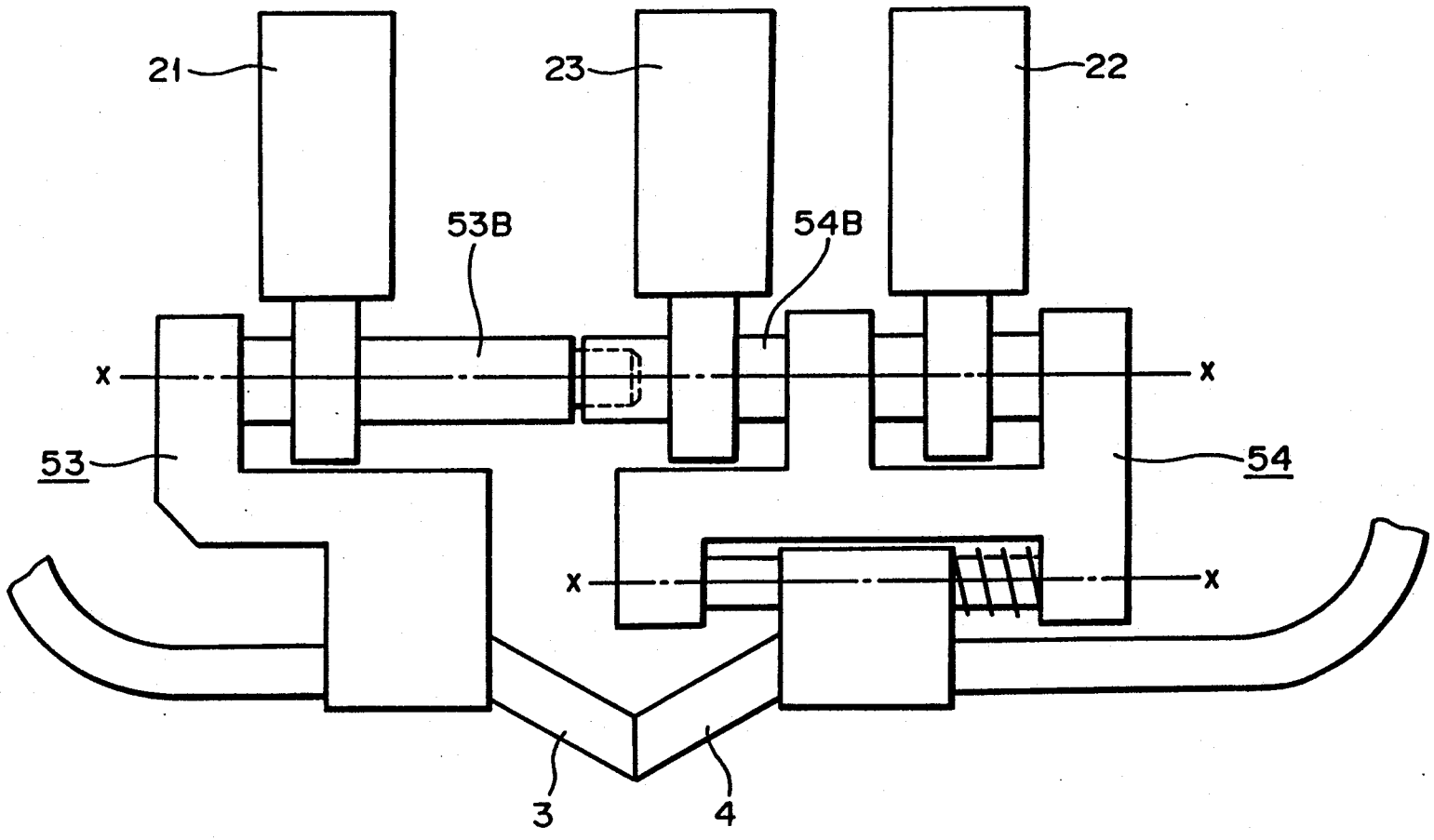
FIG. 6 is a front elevational view showing a holding mode for the nozzle chuck of the device of the present invention.
Figure 7:
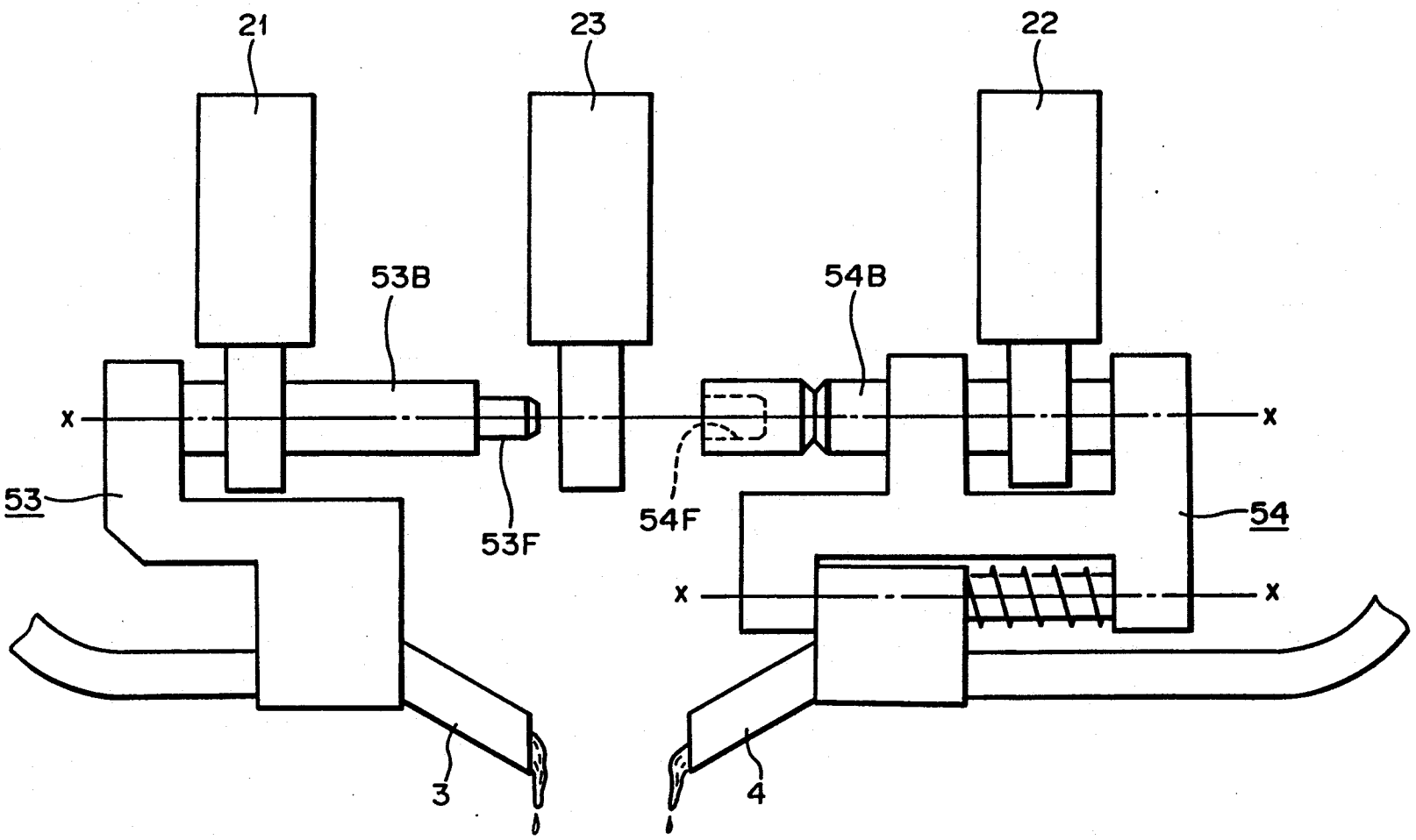
FIG. 7 is a front elevational view showing another holding mode for the nozzle chucks of the device of the present invention.
Figure 10:
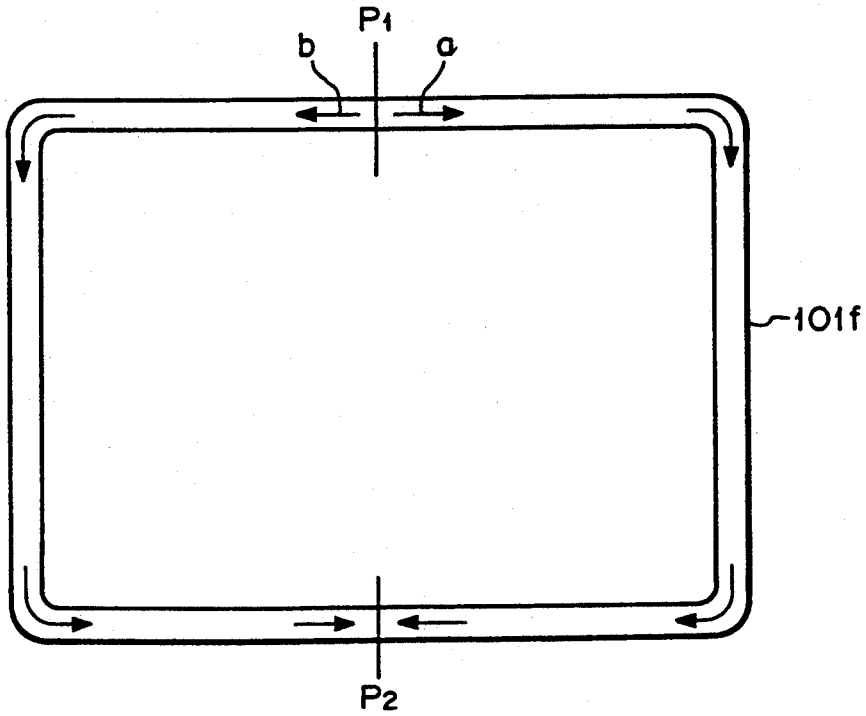
Figure 11A:
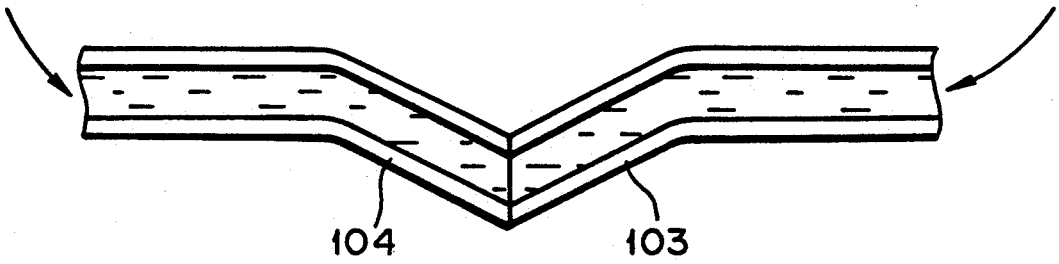
FIGS 11A and 11B are fragmentary cross-sectional views showing nozzles that are closed and opened, respectively.
Figure 11B:
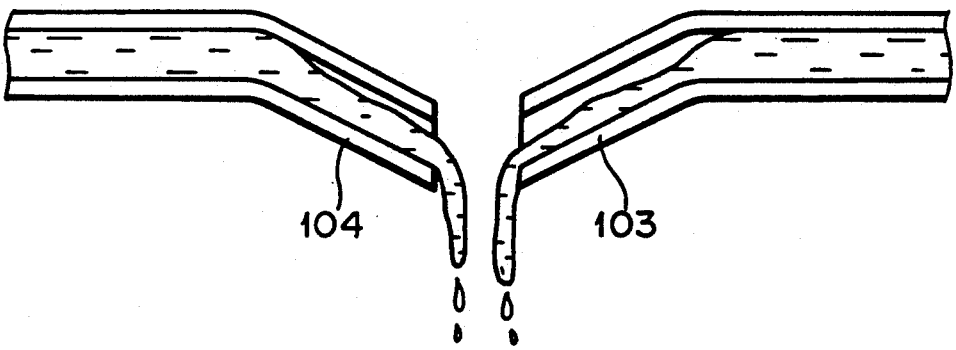

Then, the nozzles 3, 4 held in the other position $P_2$ is held by the first and third nozzle chucks 21, 23 while the nozzles 3, 4 are mating with each other and being closed. More specifically, the rods 53B, 54B of the nozzle holding means 53, 54 are gripped and held by the nozzle chucks 21, 23 of the first robot 1 at the respective grooves 71, 73 (FIG. 3), as shown in FIG. 6, so that the rods 53B, 54B are held by the same first robot 1. While the nozzles 3, 4 are being held in a predetermined positional relationship without being positionally displaced for the leakage of the fluid coating material, the nozzles 3, 4 are brought to the starting point Pl as shown in FIG. 10. Then, the nozzle chuck 22 of the second robot 2 grips the rod 54B at the second groove 7, and the third nozzle chuck 23 of the first robot 1 releases the rod 54B. The first and second robots 1, 2 now separate the nozzles 3, 4 from each other, thus opening these nozzles 3, 4, as shown in FIG. 7. The first and second robots 1, 2 are operated (moved) based on the stored data with respect to the position, shape, etc., of the surface 5, i.e., the open end of the funnel 101*f*, to move the nozzles 3, 4 respectively clockwise and counterclockwise in the directions indicated by the arrows b, a as shown in FIG. 10 to the symmetric ending point $P_2$ where the nozzles 3, 4 mate with each other again. For mating engagement of the nozzles 3, 4, the rods 53B, 54B of the nozzle holding means 53, 54 are moved toward each other along the axis x until the projection 53F fits into the recess 54F, and the open ends of the nozzles 3, 4 are resiliently held against each other under the resiliency in the direction x of the spring 54E of the nozzle holder 54A.

Under this condition, the rod 54B of the nozzle holding means 54 is gripped and held again by the third nozzle chuck 23, and released from the nozzle chuck 22 of the second robot 2. The second nozzle 4 as well as the first nozzle 3 is held by the first robot 1 so that the first and second nozzles 3, 4 will not be moved relatively to each other in the directions indicated by the arrows x, y, z. The nozzles 3, 4 are then moved to another position by the first robot 1.

Figure 8:
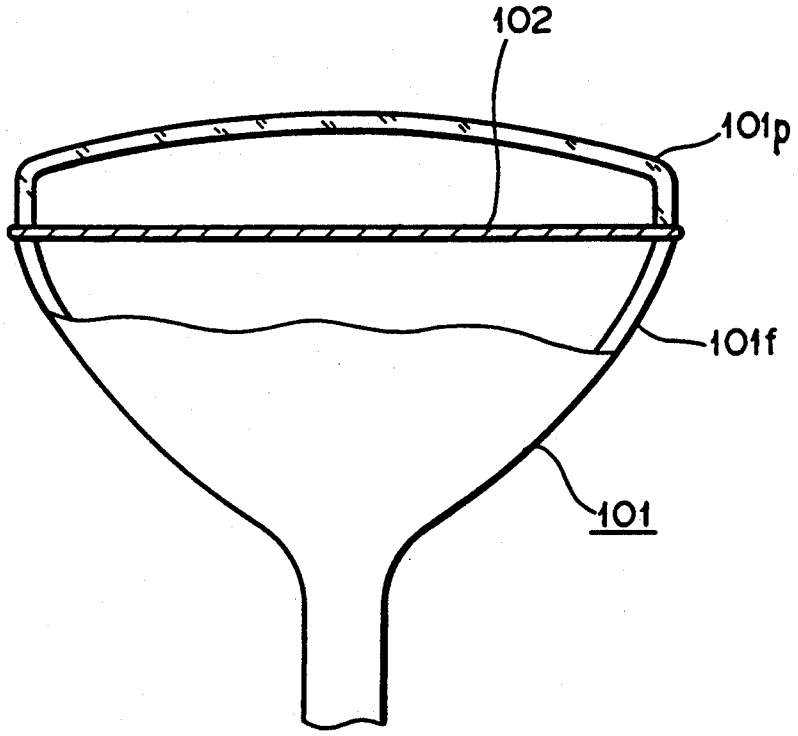
FIG. 8 is a side elevational view, partly in cross-section, of a cathode-ray tube, illustrative of an application in which a fluid is applied.
Figure 9:
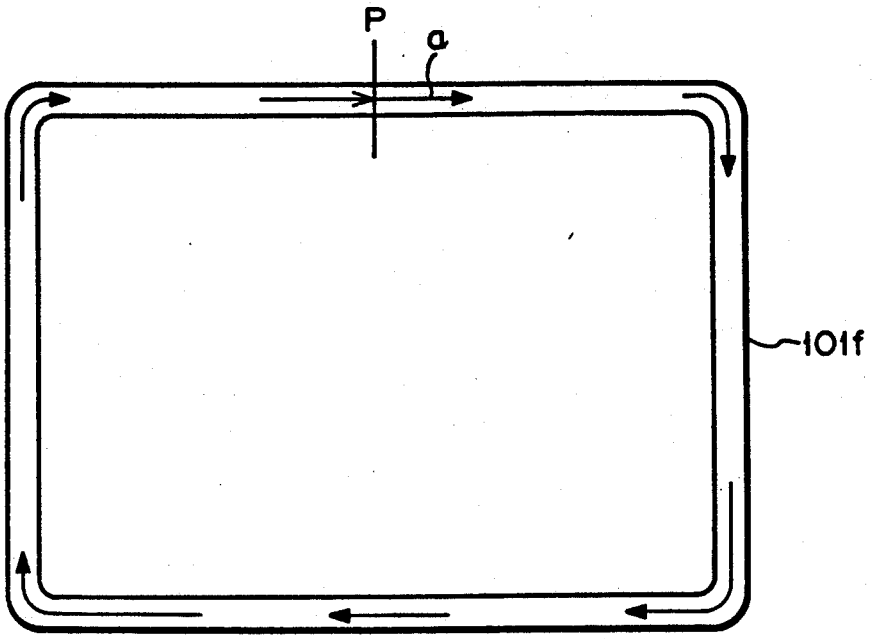
FIGS. 9 and 10 are views showing different modes of applying a frit.

Thereafter, the funnel 101*f*, to which the fluid coating material, i.e., the glass frit, has been applied, is brought to another area by another robot, and is temporarily baked. The panel 101*p* shown in FIG. 8 is placed on the funnel 101*f* in alignment therewith, and they are baked to produce a frit seal therebetween.

With the present invention, since the nozzles 3, 4 are held by the common first robot immediately before the fluid coating material is applied by the nozzles 3, 4 and when the application of the fluid coating material is finished. When the fluid coating material starts and stops being applied, therefore, the nozzles 3, 4 are not positionally displaced from each other, but remain reliably positionally aligned with each other. The nozzles 3, 4 can apply the fluid coating material uniformly without excessive or insufficient fluid application even at the starting and ending points of the fluid applying process.

In the above embodiment, the present invention is applied to the device for applying a frit seal material to the funnel 101*f* of the cathode-ray tube body. The present invention is also applicable to the uniform application of various fluid coating materials including adhesives, paints, etc.

As described above, the fluid coating material is applied to the surface 5 while the first and second nozzles 3, 4 are being moved by the first and second robots 1, 2. When the nozzles 3, 4 start and stop applying the fluid coating material, they are held by the same robot. Therefore, the nozzles 3, 4 are prevented from being positionally displaced from each other. The nozzles 3, 4 can reliably apply the fluid coating material without unwanted fluid leakage or insufficient fluid application. Since the nozzles 3, 4 are moved in opposite directions along a loop, a frit seal material can be efficiently and uniformly applied to the funnel of a cathode-ray tube which may be of a large size, e.g., a 45-inch size. As a result, the cathode-ray tube to which the frit seal material has thus been applied is highly reliable.

It should, therefore, be understood that various changes and modifications to the presently preferred embodiments described herein will be apparent to those skilled in the art. Such changes and modifications can be made without departing from the spirit and scope of the present invention and without diminishing its attendant advantages. It is, therefore, intended that such changes and modifications be covered by the appended claims.

What is claimed is:

1. A device for applying a fluid, comprising:

at least a first robot and a second robot; and at least a first nozzle and a second nozzle for receiving respective fluid coating materials;

said first robot and said second robot being constructed and arranged to hold independently the first nozzle and the second nozzle, respectively, and to move the respective nozzles along different paths over a surface to which the fluid coating materials are applied;

wherein said first robot is further constructed and arranged to hold both said first nozzle and said second nozzle simultaneously.

2. The device according to claim 1, being operable such that said first nozzle and said second nozzle are closed when the nozzles are held against each other, and are opened when the nozzles are separated from each other.

3. The device according to claim 1, wherein said first nozzle and said second nozzle are movable from a first position over said surface along the different paths, respectively, to a second position where the first nozzle and the second nozzle mate with each other, thus following a closed path as a whole.

* * * * *